US011618041B2

(12) United States Patent
Ran et al.

(10) Patent No.: US 11,618,041 B2
(45) Date of Patent: Apr. 4, 2023

(54) BASE BODY AND DUST COLLECTOR

(71) Applicant: SUZHOU BEIANG TECHNOLOGY LTD., Suzhou (CN)

(72) Inventors: Hongyu Ran, Suzhou (CN); Yigang Liu, Suzhou (CN); Yaoyuan Lu, Suzhou (CN)

(73) Assignee: SUZHOU BEIANG TECHNOLOGY LTD., Suzhou (CN)

( * ) Notice: Subject to any disclaimer, the term of this patent is extended or adjusted under 35 U.S.C. 154(b) by 374 days.

(21) Appl. No.: 16/847,242

(22) Filed: Apr. 13, 2020

(65) Prior Publication Data

US 2020/0238299 A1 Jul. 30, 2020

Related U.S. Application Data

(63) Continuation of application No. PCT/CN2018/071816, filed on Jan. 8, 2018.

(51) Int. Cl.
*B03C 3/47* (2006.01)
*B03C 3/41* (2006.01)

(52) U.S. Cl.
CPC ..... *B03C 3/47* (2013.01); *B03C 3/41* (2013.01); *B03C 2201/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,766,318 | A * | 6/1998 | Loreth | B03C 3/60 96/69 |
| 8,357,233 | B2 * | 1/2013 | Chan | B03C 3/08 96/81 |
| 8,551,228 | B2 * | 10/2013 | Chan | B03C 3/32 96/81 |
| 8,690,998 | B2 * | 4/2014 | Ji | B03C 3/41 96/87 |
| 9,308,537 | B2 * | 4/2016 | Krichtafovitch | B03C 3/72 |
| 10,556,242 | B2 * | 2/2020 | Jeon | B03C 3/86 |
| 10,882,053 | B2 * | 1/2021 | Krichtafovitch | B03C 3/08 |
| 2015/0013541 | A1 * | 1/2015 | Vandenbelt | B03C 3/47 96/98 |

FOREIGN PATENT DOCUMENTS

| | | | |
|---|---|---|---|
| CN | 201988447 | U * | 9/2011 |
| CN | 105413874 | A * | 3/2016 |
| CN | 205436028 | U * | 8/2016 |
| CN | 105498964 | B * | 5/2017 |
| JP | 11290717 | A * | 10/1999 |
| JP | 2000000488 | A * | 1/2000 |
| JP | 2008296127 | A * | 12/2008 |

* cited by examiner

*Primary Examiner* — T. Bennett McKenzie
*Assistant Examiner* — Sonji Turner
(74) *Attorney, Agent, or Firm* — Syncoda LLC; Feng Ma

(57) ABSTRACT

A base body of a dust collector includes a pedestal, and partition plates arranged on the pedestal. The partition plates are made of insulating materials. A plurality of baffle partition plates are arranged in a length direction of the pedestal at intervals. A slot for inserting electrode sheets is formed between the adjacent partition plates. The dust collector includes the base, and further includes a collector electrode sheet and a discharging electrode sheet.

18 Claims, 6 Drawing Sheets

BASE BODY AND DUST COLLECTOR

CROSS-REFERENCE TO RELATED APPLICATIONS

The present application is a continuation of International Application No. PCT/CN2018/071816 filed on Jan. 8, 2018, which claims priority to Chinese Patent Application No. 201710998127.0 filed on Oct. 24, 2017. The disclosures of these applications are hereby incorporated by reference in their entirety.

BACKGROUND

Compared with conventional physical filter dust removal technologies, electrostatic dust collection technologies can have the advantages of using no disposables and lower maintenance cost. As such, electrostatic dust removal household product have garnered consumer attention following continuous improvements in quality of life and increasingly serious smog problems in large cities.

SUMMARY

Embodiments of the present disclosure relate to the field of electrostatic dust collector, and in particular, to a base body and a dust collector.

The base body and dust collector according to some embodiments of the present disclosure can address the technical problem of electrical arc discharge present in existing electrostatic dust removal product.

Based on the above first objective, embodiments of the present disclosure provide a base body including a pedestal and a baffle plate disposed on the pedestal;

the baffle plate is made of an insulating material;

a plurality of baffle plates are provided, and the plurality of baffle plates are arranged to be spaced apart along the length direction of the pedestal; and a slot for inserting the electrode sheet is formed between the adjacent baffle plates.

In some embodiments, the adjacent baffle plates are connected on the same end along the length direction through a connecting plate.

In some embodiments, a socket is formed on one end of the adjacent baffle plate away from the connecting plate along the length direction; and along the length direction of the pedestal, the adjacent sockets are respectively positioned at both ends of the baffle plate along the length direction.

In some embodiments, a positioning post is disposed on the baffle plate, and the positioning post is disposed in the slot;

the length direction of the positioning post is parallel with the height direction of the baffle plate; and a plurality of positioning posts are provided, and the plurality of positioning posts are arranged to be spaced apart along the length direction of the baffle plate.

In some embodiments, the base body further includes a conductive strip connected to the pedestal;

the conductive strip is made of a conductive material; and the length direction of the conductive strip is parallel with the length direction of the pedestal, and the conductive strip is disposed at one end of the baffle plate along the length direction, so that when a discharging electrode sheet is inserted into the slot, the discharging electrode sheet is in contact with and electrically connected to the conductive strip.

In some embodiments, an elastic clamp is disposed on the conductive strip;

a plurality of elastic clamps are provided, and the plurality of clamps are arranged to be spaced apart along the length direction of the conductive strip; and the elastic clamp is disposed in the slot, where the discharging electrode sheet is situated, on a side near the connecting plate, so that when the discharging electrode sheet is inserted into the slot, the discharging electrode sheet is clamped by the elastic clamp.

In some embodiments, the base body further includes a base plate.

The base plate is disposed at one side of the slot close to the pedestal along the depth direction.

In another aspect, embodiments of the present disclosure provide a dust collector including the base body, and further including a collector electrode sheet and the discharging electrode sheet; and the collector electrode sheet and the discharging electrode sheet are arranged to be sequentially inserted into the slot in a spaced apart manner along the length direction of the pedestal.

In some embodiments, an edge of the collector electrode sheet according to the embodiments of the present disclosure smoothly transitions; and/or an edge of the discharging electrode sheet smoothly transitions.

In some embodiments, an exterior of the discharging electrode sheet according to the embodiments of the present disclosure is wrapped with an insulating sleeve.

Additional aspects and advantages of the present disclosure will become apparent from the description below, or will be understood through the implementation of the present disclosure.

BRIEF DESCRIPTION OF THE DRAWINGS

In order to illustrate the technical solutions of the embodiments of the present disclosure more clearly, the drawings used in the embodiments will be briefly described below. It should be understood that the following drawings merely demonstrate certain embodiments of the present disclosure, and therefore should not be considered as limitations to the scope. For those skilled in the art, other related drawings may be obtained according to these drawings without requiring any inventive efforts.

Figure 1:
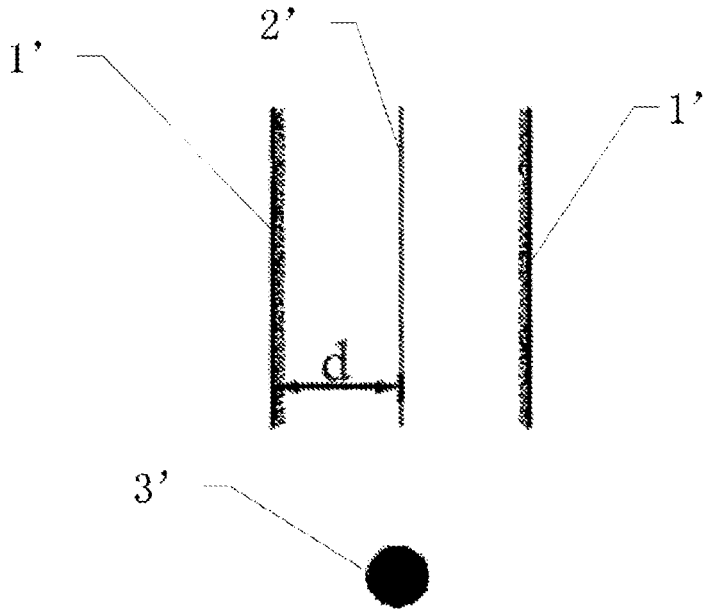
FIG. 1 (PRIOR ART)
FIG. 1 is a schematic diagram illustrating a principle of electrostatic dust collection.

In the drawings: 1'—collector electrode sheet; 2'—discharging electrode sheet; 3'—corona electrode wire; 1—pedestal; 2—baffle plate; 21—slot; 3—connecting plate; 4—positioning post; 5—conductive strip; 6—elastic clamp; 61—first elastic clamp tongue; 62—second elastic clamp tongue; 7—base plate; 81—collector electrode sheet; 82—discharge electrode sheet; 91—first opening; 92—second opening.

DETAILED DESCRIPTION

The purposes, advantages, and features of the present disclosure will be illustrated and explained below by way of non-limiting descriptions of the preferred embodiments. These embodiments are only typical examples for applying the technical solutions of the present disclosure, and any technical solutions formed by equivalent replacement or equivalent changes are within the protection scope of the present disclosure.

In the description of the embodiments of the present disclosure, it should be noted that the positions and positional relationships indicated by the terms "center," "upper," "lower," "left," "right," "vertical," "horizontal," "inside," "outside" and so on are positions and positional relationships as indicated based on the drawings, and are used merely for the convenience of describing the embodiments of the present disclosure and simplifying the description, rather than to indicate or imply that the indicated device or element must be in a specific position, or be constructed or operated in a specific position. Therefore, these positions should not be construed as limitations to the embodiments of the present disclosure. Moreover, the terms "first," "second," and "third" are merely used for descriptive purposes and should not be construed as indicating or implying any relative importance.

In the description of the embodiments of the present disclosure, it should be noted that, unless there are any explicit provision and specification, the terms "installation," "link," and "connection" should be understood broadly, which may be, for example, a fixed connection or a removable connection, or an integral connection; mechanical connection or electrical connection; direct connection or indirect connection through an intermediate medium, or may be internal communication between two elements. For those skilled in the art, the specific meanings of the above terms in the embodiments of the present disclosure can be understood depending on the specific case.

Electrostatic dust removal technology is important as a method for gas dust removal. FIG. 1 is a schematic diagram of the principle of electrostatic dust collection. The basic working principle thereof can be as follows.

First, the gas containing particle dust passes through the corona wire 3', then it is electrically separated when passing through the dust collecting electric field formed by a discharging electrode sheet 2' and a collector electrode sheet 1', so that after the particle dust is charged, the gas containing particle dust will trend towards moving to the oppositely charged collector electrode sheet 1'. That is, under the action of the electric field force, the charged particle dusts are "pressed" to the surface of the collector electrode sheet 1' in order to achieve the effect of electrostatic dust removal.

Figure 2:
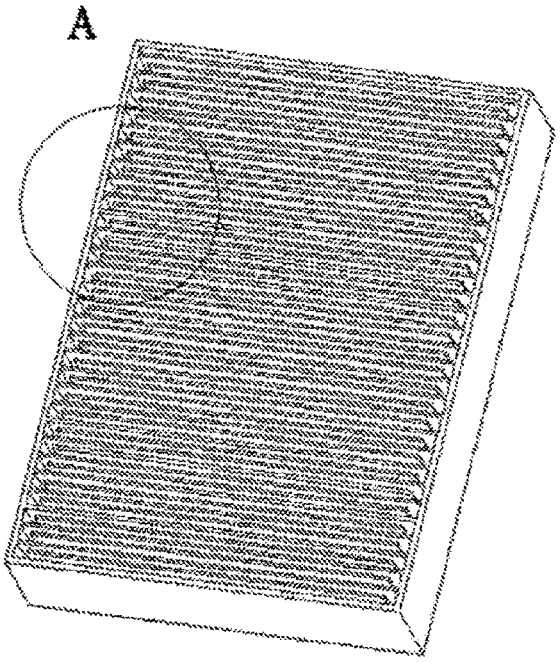
FIG. 2 (PRIOR ART)
FIG. 2 is a schematic structural view of an electrostatic dust collector in the prior art.
Figure 3:
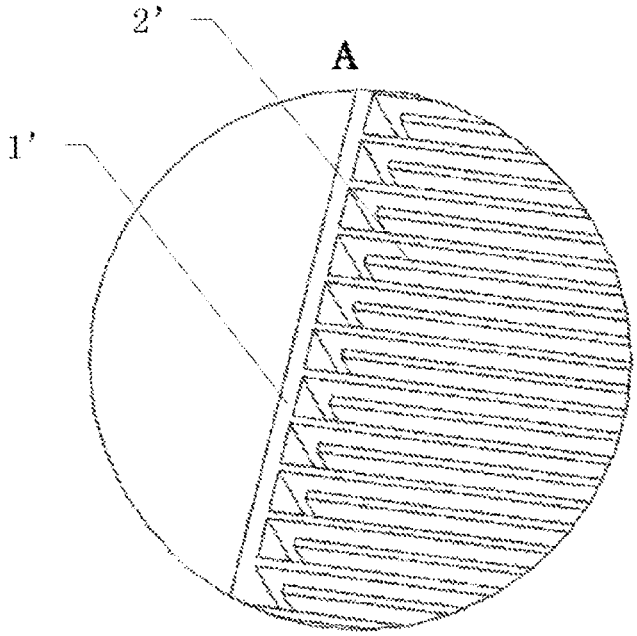
FIG. 3(PRIOR ART)
FIG. 3 is a partial enlarged view of portion A of FIG. 2.

FIG. 2 is a schematic structural view of an electrostatic duct collector in the prior art, and FIG. 3 is a partial enlarged view of portion A in FIG. 2.

The electrostatic dust collector comprises a discharging electrode sheet 2' and collector electrode sheet 1'. The discharging electrode sheet 2' and collector electrode sheet 1' are both made of a conductive plastic material. As can be seen from FIG. 3, since no insulation between the discharging electrode sheet 2' and collector electrode sheet 1' exists, electrical tracking is easily caused between the discharging electrode sheet 2' and collector electrode sheet 1', thereby forming a conductive path, so that the effective distance d of the electric field in FIG. 1 becomes very short, causing easy occurrence of electrical arc discharge.

The electrical arc discharge of the electrode sheet is a difficult problem often encountered in electrostatic dust removal products. Electrical arc discharge will generate a bright arc column, causing electrode spots and electrical tracking, and a conductive path will be gradually formed between the discharging electrode sheet and the collector electrode sheet, thus weakening the strength of the electric field between the electrode sheets. This will in turn affect dust collection efficiency. In addition, the electric spark generated by the electrical arc discharge also poses safety risks. Therefore, how to solve the technical problem of electrical arc discharge is extremely important.

Various embodiments of the present application provide a novel base body and a dust collector, which can address to the above problems.

Figure 4:
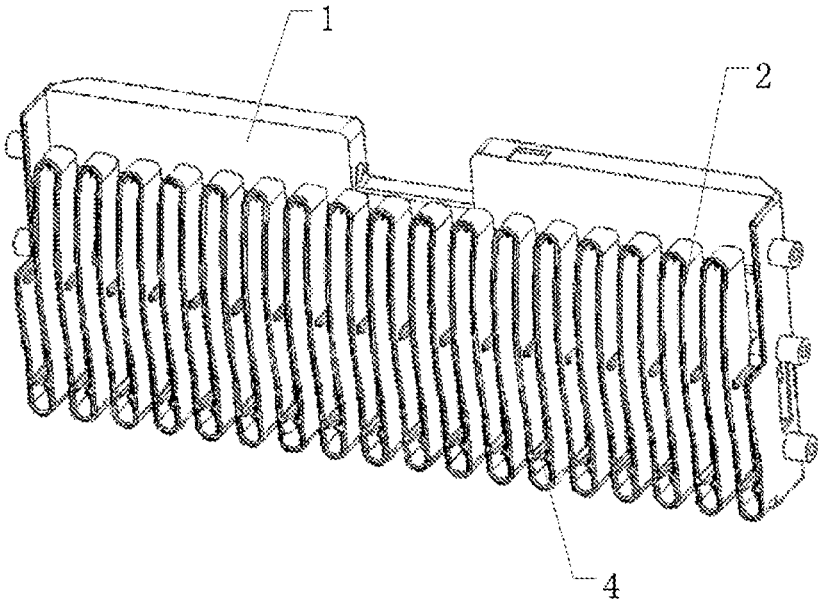
FIG. 4 is a schematic structural view of a base body according to an embodiment of the present disclosure.
Figure 5:
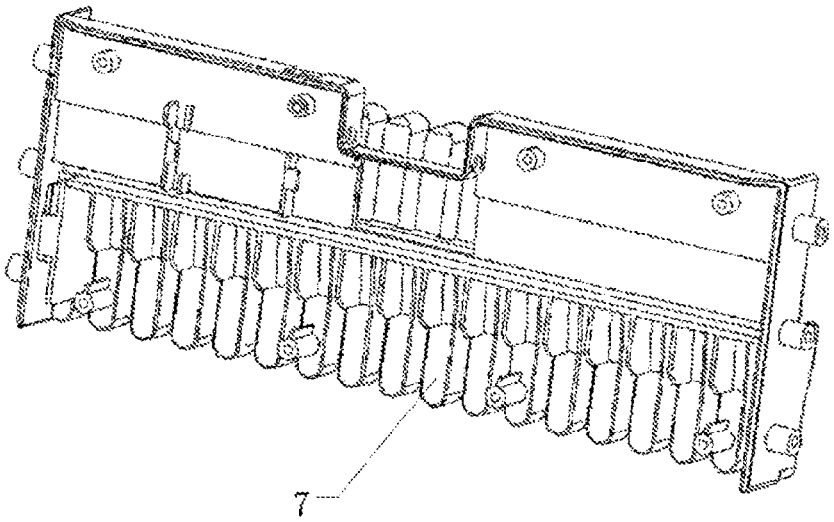
FIG. 5 is a schematic structural view of a base body according to an embodiment of the present disclosure from another view angle.
Figure 6:
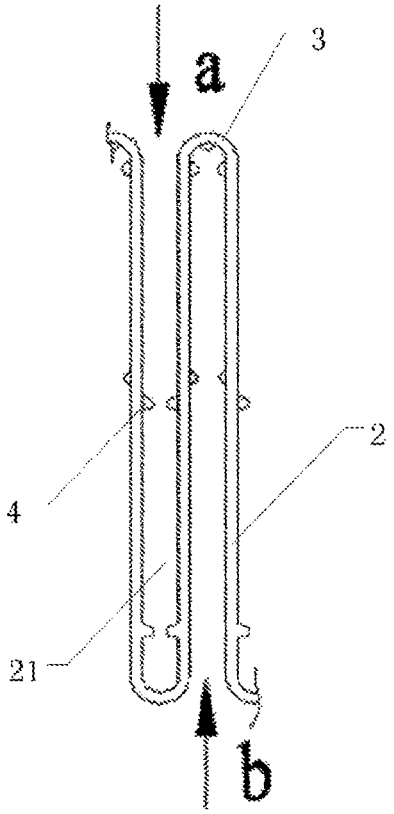
FIG. 6 is a schematic structural view of a slot of the base body according to an embodiment of the present disclosure.
Figure 7:
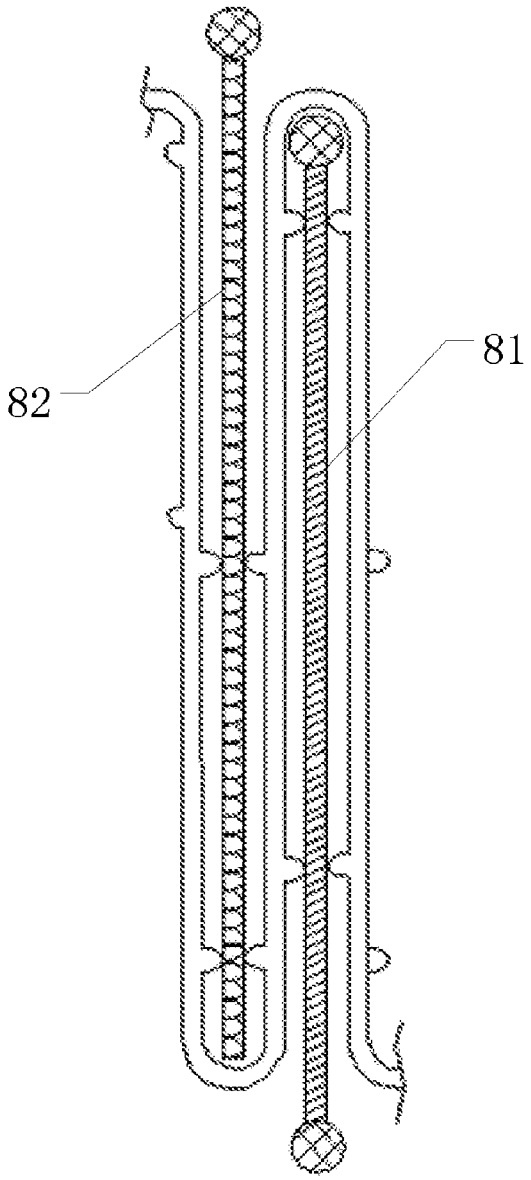
FIG. 7 is a schematic structural view of a slot of the base body according to an embodiment of the present disclosure (the state of the collector electrode sheet and discharging electrode sheet are displayed)
Figure 8A:
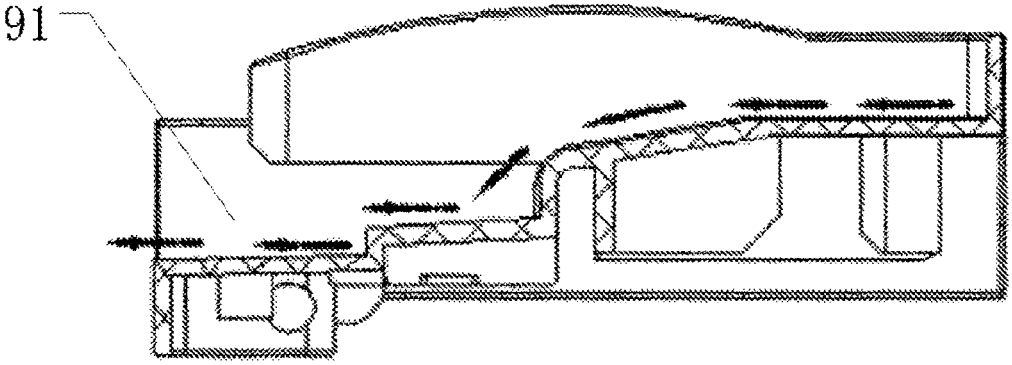
FIG. 8A is a cross-sectional view of a first cross section of the base body provided by an embodiment of the present disclosure along a length direction perpendicular to the pedestal.
Figure 8B:
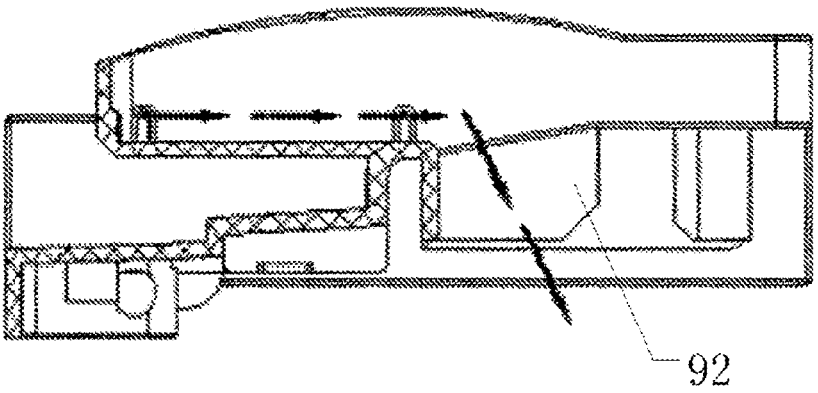
FIG. 8B is a cross-sectional view of a second cross section of the base body provided by an embodiment of the present disclosure along a length direction perpendicular to the pedestal.
Figure 9:
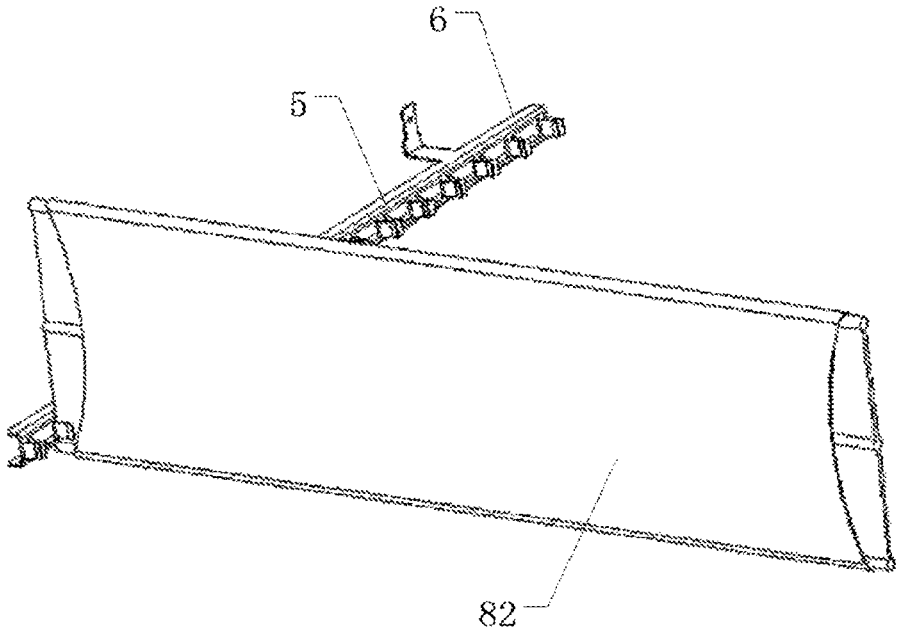
FIG. 9 is a schematic structural diagram of a conductive strip and discharging electrode sheet of the base body provided by an embodiment of the present disclosure.
Figure 10:
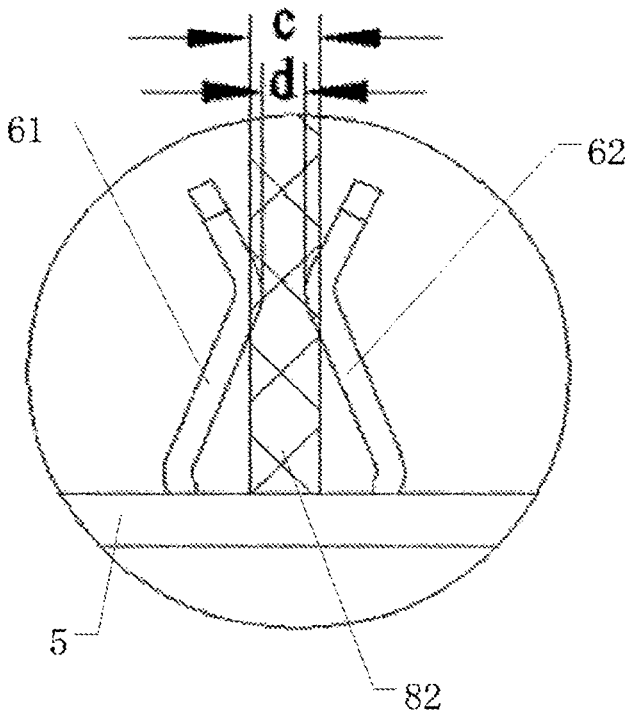
FIG. 10 is a structural schematic view showing the elastic clamp and discharging electrode sheet of the base body as shown in FIG. 9.

FIG. 1 is a schematic diagram of the principle of electrostatic dust collection; FIG. 2 is a schematic structural view of an electrostatic dust collector in the prior art; FIG. 3 is a partial enlarged view of portion A of FIG. 2; FIG. 4 is a schematic structural view of a base body according to an embodiment of the present disclosure; FIG. 5 is a schematic structural view of a base body according to an embodiment of the present disclosure from another view angle; FIG. 6 is a schematic structural view of a slot of the base body according to an embodiment of the present disclosure; FIG. 7 is a schematic structural view of a slot of the base body according to an embodiment of the present disclosure (the state of the collector electrode sheet and discharging electrode sheet are displayed); FIG. 8A is a cross-sectional view of a first cross section of the base body provided by an embodiment of the present disclosure along a length direction perpendicular to the pedestal; FIG. 8B is a cross-sectional view of a second cross section of the base body provided by an embodiment of the present disclosure along a length direction perpendicular to the pedestal; FIG. 9 is a schematic structural diagram of the conductive strip and discharging electrode sheet of the base body provided by an embodiment of the present disclosure; and FIG. 10 is a structural schematic view showing the elastic clamp and the discharging electrode sheet of the base body as shown in FIG. 9.

Embodiment 1

Referring to FIG. 4 to FIG. 10, various embodiments of the present disclosure provide a base body, comprising a pedestal 1 and a baffle plate 2 disposed on the pedestal;

the baffle plate 2 is made of an insulating material;

with reference to FIG. 4, a plurality of baffle plates 2 are provided, and the plurality of the baffle plates 2 are arranged to be spaced apart along a length direction of the pedestal; and a slot 21 for inserting the electrode sheet is formed between the adjacent baffle plates 2.

In some embodiments, the plurality of baffle plates 2 are parallel with each other, and the baffle plates 2 are perpendicular to the length direction of the pedestal 1.

It should be noted that, the electrode sheets comprise a collector electrode sheet 81 and a discharging electrode sheet 82.

When in use, the discharging electrode sheet and the collector electrode sheet are respectively inserted and disposed in the slots, so that the discharging electrode sheet and the collector electrode sheet are arranged to be sequentially spaced apart along the length direction of the pedestal; that is, the discharging electrode sheet and the collector electrode sheet are interposed, such as disposing the electrode sheets in the following sequence from a slot at one end to the slot at the other end along the length direction of the pedestal: a discharging electrode sheet, a collector electrode sheet, a discharging electrode sheet, a collector electrode sheet, and so on; or a collector electrode sheet, a discharging electrode sheet, a collector electrode sheet, a discharging electrode sheet, and so on.

As such, the base body provided by this embodiment enables the collector electrode sheet and the repeller electrode sheet to be separated by an insulating baffle plate in their respective slots, thereby increasing the creepage distance of the collector electrode sheet and the repeller electrode sheet. Through a method of increasing the electrical arc discharge paths, damage to the electrode sheet caused by the electrical arc is avoided, thereby avoiding damage to the electrode sheet caused by the electrical arc, thus solving the technical problem of electrical arc discharge present in existing electrostatic dust removal products.

In some embodiments, with reference to FIG. 6, the adjacent baffle plates 2 are connected on the same end along the length direction through a connecting plate 3.

When the discharging electrode sheet and the collector electrode sheet are inserted into the slot, the discharging electrode sheet and the collector electrode sheet are inserted into the slot from the end of the slot away from the connecting sheet along the length direction.

In some embodiments, the baffle plate 2 is integrally formed with the connecting plate 3 or joined through methods such as bonding, screwing, or the like.

Not only has the position limiting function for the inserted discharging electrode sheet and collector electrode sheet in the slot been implemented, but also, the sealed structure of the slot further blocks the discharge path of the arc.

In some embodiments, the connecting plate 3 is a curved plate, and the curved concave surface of the curve is away from the baffle plate, so that the slot 21 forms a U-shaped slot.

In some embodiments, with reference to FIG. 6, a socket is formed on one end of the adjacent baffle plate 2 away from the connecting plate 3 in the length direction; and along the length direction of the pedestal 1, the adjacent sockets are respectively positioned at both ends of the baffle plate 2 along the length direction.

When in use, the electrode sheet is inserted from the socket into the slot.

As such, the mutual insertion of adjacent electrode sheets is achieved. With reference to FIG. 6, the collector electrode sheet is inserted into the slot from the socket in direction a, and extends along the length direction of the slot to a side close to the connecting plate; the discharging electrode sheet is inserted into the slot from the socket in direction b, and extends along the length of the slot to the side close to the connecting plate; or the collector electrode sheet is inserted into the slot from the socket in direction b, and extends inwards in the length direction of the slot; and the discharging electrode sheet is inserted into the slot from the socket in direction a and extends inwards along the length direction of the slot.

In some embodiments, with reference to FIG. 6, the baffle plate is provided with a positioning post 4, and the positioning post 4 is disposed in the slot 21;

the length direction of the positioning post 4 is parallel with the height direction of the baffle plate 2; and a plurality of positioning posts 4 are provided, and the plurality of positioning posts 4 are arranged to be spaced apart along the length direction of the baffle plate 2.

In some embodiments, both sides of the baffle plate are provided with positioning posts in the thickness direction, so that both sides of the electrode sheet and the baffle plate are positioned and fixed through the positioning posts.

It should be noted that, the length direction of the baffle plate is consistent with the length direction of the slot; the height direction of the baffle plate is consistent with the depth direction of the slot; and the length direction of the slot is perpendicular to the depth direction of the slot.

When in use, the electrode sheet is in contact with the positioning post, thereby achieving positioning and fixing of the electrode sheet; that is, the electrode sheet is inserted into the slot through the positioning post and forms a line contact with the slot instead of a surface contact, so as to greatly reduce the probability of creepage along the baffle plate that causes the electrode sheet to form creepage paths.

In some embodiments, with reference to FIG. 9, the base body according to this embodiment of the present disclosure further comprises a conductive strip 5 connected to the pedestal 1;

the conductive strip 5 is made of a conductive material; and the length direction of the conductive strip 5 is parallel with the length direction of the pedestal 1, and the conductive strip 5 is disposed at one end of the baffle plate 2 along the length direction, so that when the discharging electrode sheet is inserted into the slot, the discharging electrode sheet is in contact with and electrically connected to the conductive strip.

In some embodiments, the conductive strips 5 are connected to the pedestal 1 by bolt-connection or snap-fit or buckle-fit.

After the discharging electrode sheet is inserted into the slot, the plurality of discharging electrode sheets are all electrically connected to the conductive strips; when the conductive strips are powered, powering of a plurality of discharging electrode sheets is achieved, and an equipotential is formed, thereby ensuring that the strength of the electric field at which the plurality of discharging electrode sheets participate is the same.

In some embodiments, the conductive strip 5 is provided with an elastic clamp 6;

a plurality of elastic clamps 6 are provided, and the plurality of clamps 6 are arranged to be spaced apart along the length direction of the conductive strip 5; and the elastic clamp 6 is disposed in the slot, where the discharging electrode sheet is situated, on a side near the connecting plate, so that when the discharging electrode sheet is inserted into the slot, the discharging electrode sheet is clamped by the elastic clamp.

In some embodiments, as shown in FIG. 10, the elastic clamp 6 comprises a first elastic tongue 61 and a second elastic tongue 62. the first elastic tongue 61 and the second elastic tongue 62 are oppositely disposed, and the minimum distance between the first elastic tongue 61 and the second elastic tongue 62 is d; and with reference to FIG. 10, the thickness of the discharging electrode sheet 82 is c, and d<c; after the discharging electrode sheet 82 is inserted into the slot, the first elastic tongue 61 and the second elastic tongue 62 of the elastic clamp are pushed open; the elastic effect causes the first elastic tongue 61 and the second elastic tongue 62 to hold the discharging electrode sheet in a deadlock, so as to effectively solve the problem related to the risk of low dust collection efficiency caused by poor contact between the discharging electrode sheet 82 and the conductive strip, thereby ensuring that each discharging electrode sheet 82 can be conductive.

In some embodiments, with reference to FIG. 5, the base body according to this embodiment of the present disclosure further comprises a base plate 7; and the base plate 7 is disposed at one side of the slot close to the pedestal 1 in a depth direction, which has blocked the paths of electrical arc discharge and tip discharge of the discharging electrode sheet 82 and collector electrode sheet 81.

In some embodiments, the baffle plate 2 has a height greater than the height of the electrode sheet; that is, the electrode sheet is inserted and disposed in the slot 21, and the projection of the electrode sheet is within the baffle plate 2 along the length direction of the pedestal 1, so that the baffle plate 2 forms a wall for the electrode sheet, which blocks the paths of electrical arc discharge and tip discharge of the adjacent collector electrode sheet 81 and discharging electrode sheets 82.

In some embodiments, along the length of the pedestal 1, one of the adjacent slots 21 is the first slot, and the other is the second slot.

Referring to FIG. 8A, a first opening 91 is provided in the pedestal. The first opening 91 is communicated with the first slot, and the first opening 91 is provided at the bottom of the first slot. With reference to FIG. 8B, a second opening 92 is provided in the pedestal 1; the second opening 92 is communicated with the second slot and is provided at the bottom of the second slot; and the first opening 91 and the second opening 92 are respectively positioned at both ends of the baffle plate along the length direction.

That is, along the length direction of the pedestal 1, the first opening 91 and second opening 92 are arranged to be spaced apart.

When the dust collector is being cleaned, the water stored in the slot respectively flows out from the openings on both sides. Specifically, water stored in the first slot flows out from the first opening 91, and water stored in the second slot flows out from the second opening 92. The water flows out from two oppositely butted openings, and the two openings formed separately flow obliquely downward. In this manner, water is not easily stored in the slot, greatly shortening the drying time of the base body and reducing the discharge caused by the conductivity of the stored water.

In some embodiments, each collector electrode sheet is integrated on the collector electrode plate and integrally molded through plastic injection and by adopting a non-crystalline, hydrophobic conductive plastic material with a flame retardant have a grade of V0, and a volume resistivity of less than $10^6$ Ω·cm.

Embodiment 2

Embodiment 1 provides a dust collector, and the dust collector comprises the base body according to Embodiment 1; the technical features of the base body disclosed in Embodiment 1 are also applicable to this embodiment, and the technical features of the base body disclosed in Embodiment 1 will not be described again herein. The implementation method of the dust collector will be further described in detail below with reference to the accompanying drawings.

In order to be succinct, the improved features of this embodiment are also illustrated in FIGS. 4 to 10, and therefore, the solution in this embodiment will be described with reference to FIGS. 4 to 10.

Referring to FIG. 4 to FIG. 10, the dust collector provided in these embodiments comprises the base body, and further comprises a collector electrode sheet 81 and a discharging electrode sheet 82; and The collector electrode sheet 81 and the discharging electrode sheet 82 are arranged to be sequentially inserted into the slot 21 in a spaced apart manner along the length direction of the pedestal 1.

In this manner, the discharging electrode sheet 82 and the collector electrode sheet 81 are disposed sequentially in a spaced apart manner along the length direction of the pedestal, such as disposing the electrode sheets in the following sequence from a slot at one end to the slot at the other end along the length direction of the pedestal 1: a discharging electrode sheet, a collector electrode sheet, a discharging electrode sheet, a collector electrode sheet, and so on; or a collector electrode sheet, a discharging electrode sheet, a collector electrode sheet and a discharging electrode sheet, and so on.

As such, the dust collector provided in this embodiment enables the collector electrode sheet and the repeller electrode sheet to be separated in their respective slots, thereby increasing the creepage distance of the collector electrode sheet and the repeller electrode sheet; and through a method of increasing the electrical arc discharge paths, damage to the electrode sheet caused by the electrical arc is avoided, thereby avoiding damage to the electrode sheet caused by the electrical arc, and further solving the technical problem of electrical arc discharge present in existing electrostatic dust removal products.

In some embodiments, an edge of the collector electrode sheet 81 smoothly transitions; and/or an edge of the discharging electrode sheet 82 smoothly transitions.

Specifically, the edge of the collector electrode sheet smoothly transitions; or, the edge of the discharging electrode sheet smoothly transitions; or, the edge of the collector electrode sheet smoothly transitions, and further, the edge of the discharging electrode sheet smoothly transitions.

In some embodiments, the edge of the collector electrode sheet smoothly transitions, and the edge of the discharging electrode sheet smoothly transitions.

In the prior art, with reference to FIG. 1, each discharging electrode sheet has a tip end. Since the tip end of the electrode sheet has a relatively high curvature and a high surface charge density value, the strength of the electric field in the vicinity thereof is especially strong, so as to easily break down and ionize the air to form positive and negative ions. The ions in the air with an opposite charge with the charge of the electrode sheet will neutralize the charge of the electrode sheet, thus weakening the strength of the electric field between the electrode sheets, generating electrical sparks, and generating a "buzzing" electrical discharge sound that can be heard. In other words, a tip discharge that is generated will also affect the dust collection efficiency of the overall dust collection module.

On the one hand, for the dust collector provided in this embodiment, as each electrode sheet is in its respective slot, even if a relatively strong electric field is generated at the tip end of the electrode sheet, tip discharge will not occur. On the other hand, both the edge of the collector electrode sheet and the edge of the collector electrode sheet smoothly transition, thereby effectively avoiding tip discharge.

In some embodiments, an exterior of the discharging electrode sheet 82 is wrapped with an insulating sleeve.

In some embodiments, the insulating sleeve is a heat shrinkable insulating sleeve or is made of another insulating material to further reduce the risk of tip discharge.

The dust collector in this embodiment has the advantages of the base body in Embodiment 1. The advantages have been described in detail in Embodiment 1 and will not be repeated again herein.

Various embodiments of the present disclosure can have one or more of the following advantages.

The electrode sheets comprise a collector electrode sheet and a discharging electrode sheet. When in use, the discharging electrode sheet and the collector electrode sheet are respectively inserted into the slots, so that the discharging electrode sheet and the collector electrode sheet are arranged to be sequentially spaced apart along the length direction of the pedestal; that is, the discharging electrode sheet and the collector electrode sheet are interposed, such as disposing the electrode sheets in the following sequence from a slot at one end to the slot at the other end along the length direction of the pedestal: a discharging electrode sheet, a collector electrode sheet, a discharging electrode sheet, a collector electrode sheet, and so on; or a collector electrode sheet, a discharging electrode sheet, a collector electrode sheet, a discharging electrode sheet, and so on.

As such, the base body enables the collector electrode sheet and the repeller electrode sheet to be separated by an insulating baffle plate in their respective slots, thereby increasing the creepage distance of the collector electrode sheet and the repeller electrode sheet; and through a method of increasing the electrical arc discharge paths, damage to the electrode sheet caused by the electrical arc is avoided, thereby avoiding damage to the electrode sheet caused by the electrical arc, thus solving the technical problem of electrical arc discharge present in existing electrostatic dust removal products.

The dust collector as provided by the embodiments of the present disclosure comprises the base body, which has further solved the technical problem of electrical arc discharge present in existing electrostatic dust removal products.

In some embodiments, an air purification system can be provided, including one or more dust collectors described above, having respectively one or more base bodies. The air purification system can further include, for example, a power supply, a controller, a user interface, a display screen, etc. The system can be employed in a small environment such as a space inside an automobile, or a larger space such as a room, a house, an office space, a building, etc. to purify air therein or thereabout.

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

The above description includes part of embodiments of the present disclosure, and not limits the present disclosure. Any modifications, equivalent substitutions, improvements, etc., within the spirit and principles of the present disclosure, are included in the scope of protection of the present disclosure.

It is apparent that those of ordinary skill in the art can make various modifications and variations to the embodiments of the disclosure without departing from the spirit and scope of the disclosure. Thus, it is intended that the present disclosure cover the modifications and the modifications.

Various embodiments in this specification have been described in a progressive manner, where descriptions of some embodiments focus on the differences from other embodiments, and same or similar parts among the different embodiments are sometimes described together in only one embodiment.

It should also be noted that in the present disclosure, relational terms such as first and second, etc., are only used to distinguish one entity or operation from another entity or operation, and do not necessarily require or imply these entities having such an order or sequence. It does not necessarily require or imply that any such actual relationship or order exists between these entities or operations.

Moreover, the terms "include," "including," or any other variations thereof are intended to cover a non-exclusive inclusion within a process, method, article, or apparatus that comprises a list of elements including not only those elements but also those that are not explicitly listed, or other elements that are inherent to such processes, methods, goods, or equipment.

In the case of no more limitation, the element defined by the sentence "includes a . . . " does not exclude the existence of another identical element in the process, the method, or the device including the element.

Specific examples are used herein to describe the principles and implementations of some embodiments. The description is only used to help convey understanding of the possible methods and concepts. Meanwhile, those of ordinary skill in the art can change the specific manners of implementation and application thereof without departing from the spirit of the disclosure. The contents of this specification therefore should not be construed as limiting the disclosure.

For example, in the description of the present disclosure, the terms "some embodiments," or "example," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In the descriptions, with respect to circuit(s), unit(s), device(s), component(s), etc., in some occurrences singular forms are used, and in some other occurrences plural forms are used in the descriptions of various embodiments. It should be noted; however, the single or plural forms are not limiting but rather are for illustrative purposes. Unless it is expressly stated that a single unit, device, or component etc. is employed, or it is expressly stated that a plurality of units, devices or components, etc. are employed, the circuit(s), unit(s), device(s), component(s), etc. can be singular, or plural.

Based on various embodiments of the present disclosure, the disclosed apparatuses, devices, and methods can be implemented in other manners. For example, the abovementioned devices can employ various methods of use or implementation as disclosed herein.

In the present disclosure, the terms "installed," "connected," "coupled," "fixed" and the like shall be understood broadly, and may be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

Dividing the device into different "regions," "units," "components" or "layers," etc. merely reflect various logical functions according to some embodiments, and actual implementations can have other divisions of "regions," "units," "components" or "layers," etc. realizing similar functions as described above, or without divisions. For example, multiple regions, units, or layers, etc. can be combined or can be integrated into another system. In addition, some features can be omitted, and some steps in the methods can be skipped.

Those of ordinary skill in the art will appreciate that the units, components, regions, or layers, etc. in the devices provided by various embodiments described above can be provided in the one or more devices described above. They can also be located in one or multiple devices that is (are) different from the example embodiments described above or illustrated in the accompanying drawings. For example, the units, regions, or layers, etc. in various embodiments described above can be integrated into one module or divided into several sub-modules.

The various device components, modules, units, blocks, or portions may have modular configurations, or are composed of discrete components, but nonetheless can be referred to as "modules" or "units" in general. In other words, the "components," "modules," "blocks," "portions," or "units" referred to herein may or may not be in modular forms.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

The order of the various embodiments described above are only for the purpose of illustration, and do not represent preference of embodiments.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to the disclosed aspects of the exemplary embodiments can be made in addition to those described above by a person of ordinary skill in the art having the benefit of the present disclosure without departing from the spirit and scope of the disclosure contemplated by this disclosure and as defined in the following claims. As such, the scope of this disclosure is to be accorded the broadest reasonable interpretation so as to encompass such modifications and equivalent structures.

The invention claimed is:

1. A base body, comprising:

a pedestal; and a baffle plate disposed over the pedestal;

wherein the baffle plate is made of an insulating material;

a plurality of baffle plates including the baffle plate are provided, and the plurality of baffle plates are arranged to be spaced apart along a length direction of the pedestal;

a slot for inserting an electrode sheet is formed between adjacent baffle plates;

the adjacent baffle plates are connected at adjacent ends of the adjacent baffles along the length direction of the pedestal through a curved connecting plate;

the curved connecting plate has a curved concave surface such that the slot is U-shaped;

the base body further comprises a conductive strip connected to the pedestal;

the conductive strip is made of a conductive material; and a length direction of the conductive strip is parallel with the length direction of the pedestal, and the conductive strip is disposed at one end of the baffle plate along the length direction of the pedestal, to thereby facilitate a discharging electrode sheet, when inserted into the slot, being in contact with and electrically connected to the conductive strip.

2. The base body according to claim 1, wherein a socket is formed on one end of the adjacent baffle plate distal from the connecting plate along the length direction of the pedestal; and adjacent sockets are respectively positioned at both ends of the baffle plate along the length direction of the pedestal.

3. The base body according to claim 1, wherein the baffle plate is provided with a positioning post, and the positioning post is disposed in the slot;

a length direction of the positioning post is parallel with a height direction of the baffle plate; and a plurality of positioning posts including the positioning post are provided, and the plurality of positioning posts are arranged to be spaced apart along a length direction of the baffle plate.

4. The base body according to claim 1, wherein the conductive strip is provided with an elastic clamp;

a plurality of elastic clamps including the elastic clamp are provided, and the plurality of elastic clamps are arranged to be spaced apart along the length direction of the conductive strip; and the elastic clamp is disposed in the slot, where the discharging electrode sheet is situated, on a side proximal to the connecting plate, such that when the discharging electrode sheet is inserted into the slot, the discharging electrode sheet is clamped by the elastic clamp.

5. The base body according to claim 1, further comprising a base plate.

6. A dust collector, comprising a base body, a collector electrode sheet and a discharging electrode sheet; wherein the base body comprises a pedestal; and a baffle plate disposed over the pedestal;

the baffle plate is made of an insulating material;

a plurality of baffle plates including the baffle plate are provided, and the plurality of baffle plates are arranged to be spaced apart along a length direction of the pedestal;

a slot for inserting an electrode sheet is formed between adjacent baffle plates;

the adjacent baffle plates are connected at adjacent ends of the adjacent baffles along the length direction of the pedestal through a curved connecting plate; and the collector electrode sheet and the discharging electrode sheet are arranged to be sequentially inserted into the slot in a spaced apart manner along the length direction of the pedestal.

7. The dust collector according to claim 6, wherein at least one of an edge of the collector electrode sheet or an edge of the discharging electrode sheet has a shape transition to avoid tip discharge.

8. The dust collector according to claim 6, wherein an exterior of the discharging electrode sheet is wrapped with an insulating sleeve.

9. An air purification device comprising the dust collector according to claim 6, wherein the discharging electrode sheet and the collector electrode sheet are configured to be respectively inserted into slots to be sequentially spaced apart along the length direction of the pedestal.

10. The air purification device according to claim 9, wherein the discharging electrode sheet and the collector electrode sheet are interposed to form a sequence from a slot at one end to a slot at another end along the length direction of the pedestal.

11. The air purification device according to claim 10, wherein the sequence includes: a discharging electrode sheet, a collector electrode sheet, a discharging electrode sheet, a collector electrode sheet.

12. The air purification device according to claim 10, wherein the sequence includes: a collector electrode sheet, a discharging electrode sheet, a collector electrode sheet, a discharging electrode sheet.

13. The air purification device according to claim 10, wherein the base body is configured to enable the collector electrode sheet and the discharging electrode sheet to be separated by insulating baffle plates, with an increased creepage distance of the collector electrode sheet and the discharging electrode sheet.

14. The air purification device according to claim 13, wherein the increased creepage distance further increases a path length of an electrical arc discharge to avoid damage to the collector electrode sheet or the discharging electrode sheet.

15. The air purification device according to claim 14, wherein the adjacent baffle plates are connected at adjacent ends of the adjacent baffles along a length direction of the pedestal through a connecting plate;

a socket is formed on one end of the adjacent baffle plate distal from the connecting plate along the length direction of the pedestal; and adjacent sockets are respectively positioned at both ends of the baffle plate along the length direction of the pedestal.

16. The air purification device according to claim 15, wherein the baffle plate is provided with a positioning post, and the positioning post is disposed in the slot;

a length direction of the positioning post is parallel with a height direction of the baffle plate; and a plurality of positioning posts including the positioning post are provided, and the plurality of positioning posts are arranged to be spaced apart along a length direction of the baffle plate.

17. The air purification device according to claim 16, wherein the base body further comprises a conductive strip connected to the pedestal;

the conductive strip is made of a conductive material;

a length direction of the conductive strip is parallel with the length direction of the pedestal, and the conductive strip is disposed at one end of the baffle plate along the length direction of the pedestal, to thereby facilitate a discharging electrode sheet, when inserted into the slot, being in contact with and electrically connected to the conductive strip;

the conductive strip is provided with an elastic clamp;

a plurality of elastic clamps including the elastic clamp are provided, and the plurality of elastic clamps are arranged to be spaced apart along the length direction of the conductive strip; and the elastic clamp is disposed in the slot, where the discharging electrode sheet is situated, on a side proximal to the connecting plate, such that when the discharging electrode sheet is inserted into the slot, the discharging electrode sheet is clamped by the elastic clamp.

18. The air purification device according to claim 17, wherein the base body further comprises a base plate; and the base plate is disposed at one side of the slot proximal to the pedestal along the depth direction.

* * * * *